United States Patent [19]

Steidel

[11] Patent Number: 4,520,331

[45] Date of Patent: May 28, 1985

[54] ROTARY ACTUATOR FOR A MICROWAVE SWITCH

[75] Inventor: Clinton F. Steidel, La Mirada, Calif.

[73] Assignee: Transco Products, Inc., Marina Del Rey, Calif.

[21] Appl. No.: 565,880

[22] Filed: Dec. 27, 1983

[51] Int. Cl.[3] ..... H01H 67/02

[52] U.S. Cl. ..... 335/125; 333/106; 310/156

[58] Field of Search ..... 335/125, 122, 138, 229, 335/253, 272; 310/156, 261; 333/106, 107, 108

[56] References Cited

U.S. PATENT DOCUMENTS 3,970,980 7/1976 Nelson ..... 335/253

*Primary Examiner*—E. A. Goldberg
*Assistant Examiner*—George Andrews
*Attorney, Agent, or Firm*—Charles H. Schwartz; Ellsworth R. Roston

[57] ABSTRACT

A rotary actuator for a microwave switch, including, a stationary armature formed by a core positioned along a particular axis and with a coil wound around the core to form at least one electromagnet and with the polarity at the end of the core in accordance with the direction of current flow through the coil upon the application of electrical energy to the coil, a rotor positioned adjacent to one end of the core and with the rotor supported for rotation in a plane perpendicular to the particular axis of the core, the rotor including a plurality of spaced permanent magnets located axially relative to the one end of the core and with the application of electrical energy to the coil providing axial excitation to produce magnetic interaction between the permanent magnets and the core and provide rotary travel of the rotor in one of two opposite directions in accordance with the direction of current flow through the coil, and a stop located in the path of rotation of the rotor to engage a portion of the rotor to limit the travel of the rotor between fixed positions.

22 Claims, 5 Drawing Figures

20
20
60
52
62
10
22
16
50
62
22
22
104
14
24
24
96
94
106
90
92
24
98
108
136
118
26
126
112
38
114
26
138
26
3
110
120
12
116
128
26
134
18
76
74
132

60
54
60
42
60
50
52
46
44
56
36
10
30
32
48
40
38
94
90
86
108
3
92
126
120
12
5
5
80
76
82
72
88

ROTARY ACTUATOR FOR A MICROWAVE SWITCH

BACKGROUND OF THE INVENTION

1. Field of the Invention

The present invention is directed to a rotary actuator for a microwave switch and in particular to a rotary actuator using axial excitation.

2. Description of the Prior Art

In the past, rotary actuators for microwave switches have in general operated using radial excitation between a stationary armature or stator and a rotor. In other words, the actuator includes the armature and rotor radially disposed relative to each other and radially actuated relative to each other. As a specific example, references made to prior U.S. Pat. No. 3,970,980 listing Victor Nelson as the inventor and showing a rotary actuator including cylindrically curved permamently magnetized poles spaced apart at their ends and surrounding a fixed armature. The armature has magnetic arms angularly disposed with respect to each other so as to define fixed poles. Coils are wound on the fixed poles to generate magnetic fields when alternately energized so as to drive the rotor in two directions. This provides for a switching of a mechanical load which for example may be a microwave switch.

The structures produced by the radial form of rotary actuators, such as provided in the above referenced patent, are relatively bulky, cumbersome in operation and have a higher weight than desired. It would be desirable to reduce the size and weight of the rotary actuator so as to contribute to the overall reduction in size and weight of the microwave switch.

SUMMARY OF THE INVENTION

The rotary actuator of the present invention provides for an axial excitation between a stator and rotor to control the position of a microwave switch. Such actuation is provided through a particular angular rotation such as through an approximately ninety degree (90°) rotation. The actuator of the present invention is small in size and weight relative to the size of the microwave switch element being controlled. In particular the actuator is contained within a housing which has dimensions no bigger in cross section than the cross section of the microwave switch and with the actuator smaller in length than the length of the microwave switch.

The actuator includes a pair of coil members, each disposed around a separate ferris material core member and with the core members positioned side by side and disposed along parallel axes, so that upon appropriate electrical excitation of the coils, the combination of the coils and cores form electromagnets having particular polarities depending upon the direction of excitation. In general, the coil members are excited so that the cores at their adjacent ends have opposite polarities to each other and with the excitation controlled in one direction to operate the actuator in one direction and with the excitation controlled in the opposite direction to control the actuator in the opposite direction.

Adjacent one end of each of the side by side cores are two pairs of permanent magnet members and with each pair of permanent magnet members having a particular polarity orientation opposite to the other pair of permanent magnet members. The permanent magnet members are located axially relative to the core members and with current flow through the coils in a particular direction provding for excitation of the coils to produce mutual attraction and repulsion between the cores and particular ones of the pairs of permanent magnets. The permanent magnets are mounted on a rotatable plate and with the plate supported for rotation in a plane perpendicular to the parallel axes of the cores. The mutual attraction and repulsion of the permanent magnets thereby provides for rotation of the plate. The plate is connected to a rotary member contained in a microwave switch so that rotation of the plate produces rotation of the rotary member of the microwave switch into particular switch positions.

The present invention therefore produces rotary actuation of a microwave switch in accordance with an axial excitation between a pair of side by side core members and axially located permanent magnet members. In a particular embodiment of the invention, the magnetic material used for the permanent magnets is a rare earth magnetic material, such as samarium cobalt, so as to produce a powerful magnet in a relatively small size. In addition, the rotary actuator of the present invention provides for automatic latching of the switch in the actuated position upon the interruption of power. The latching is accomplished since the permanent magnets maintain the rotary actuator in the actuated position even with power off due to the attraction of the permanent magnets to the ferris material forming the side by side cores.

BRIEF DESCRIPTION OF THE DRAWINGS

A clearer understanding of the present invention will be had with reference to the following description and drawings wherein.

DESCRIPTION OF THE PREFERRED EMBODIMENT

Figure 1:
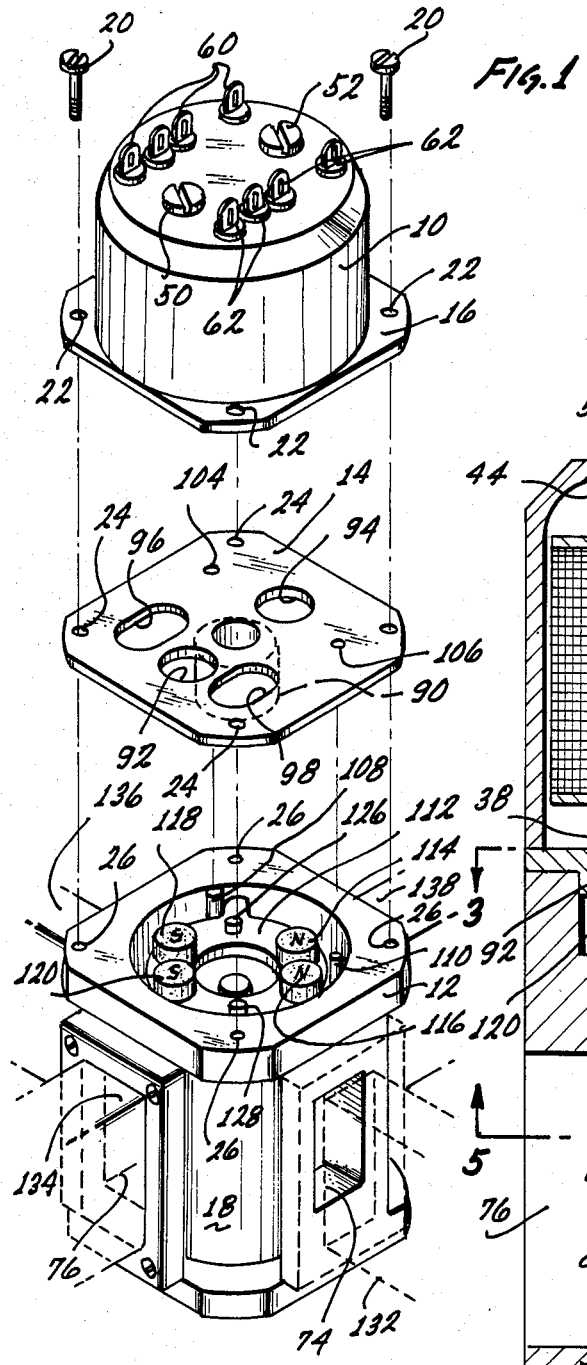
FIG. 1 illustrates an exploded view of a rotary actuator for a microwave switch of the present invention.
Figure 2:
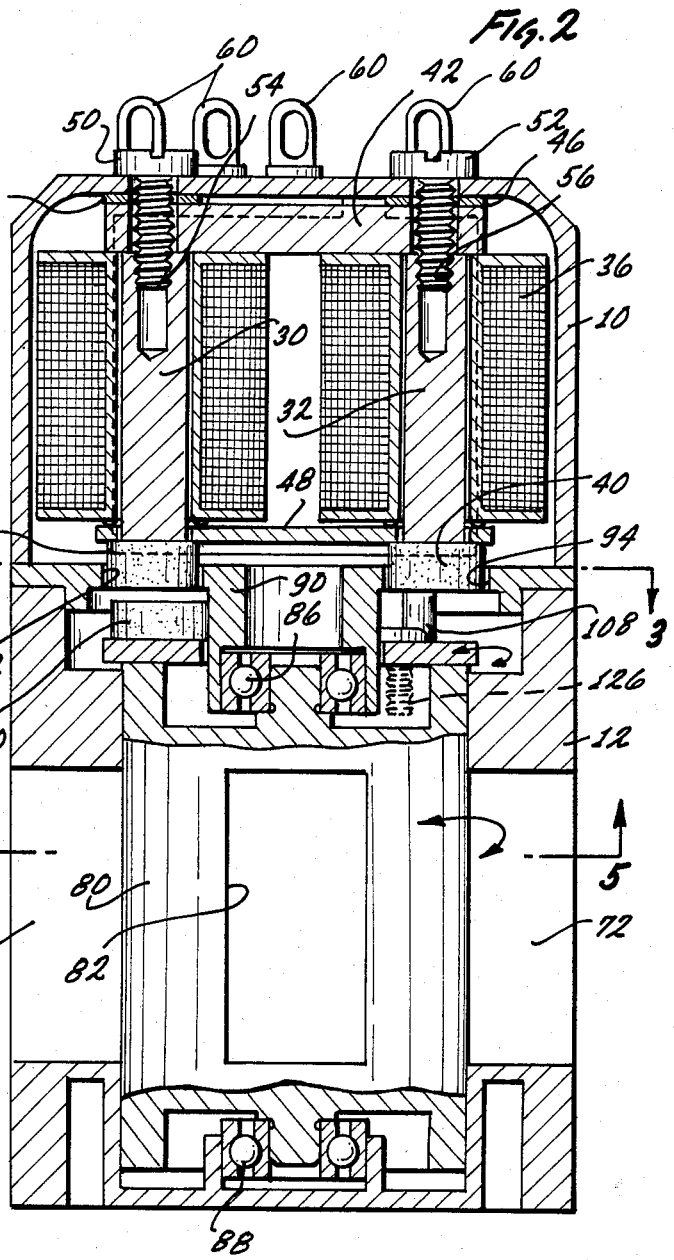
FIG. 2 is a cross-sectional view of the entire assembled structure.

As shown in FIGS. 1 and 2, a rotary actuator for a microwave switch of the present invention includes an upper housing 10 and lower housing 12 interconnected by a center plate 14. The upper housing 10 is formed as a generally cup shape cylindrical member with an outwardly extending substantially square flange portion 16 having cut off rounded corners. The center plate 14 is also substantially square with cut off rounded corners so as to match the configuration of the flange portion 16 of the upper housing 10. The lower housing 12 in turn has a generally square configuration also with cut off rounded corners. The lower housing additionally includes cut-away portions 18 at each four corners in the body of the housing 12 so as to reduce the weight. Other portions of the housing 12 may also be relieved so as to reduce the weight of the structure.

The upper housing 10, lower housing 12 and center plate 14 are all interconnected through the use of screw members 20 which pass through openings 22 in the flange 16, through openings in the center plate 14 and are received in threaded openings 26 in the housing 12.

The upper housing 10 receives and supports the actuating stationary armature or stator formed by individual side by side core members 30 and 32 positioned along parallel axes and with the core members surrounded by actuating coils 34 and 36. The cores 30 and 32 are formed of ferris material which may be magnetizied to have one of two particular polarizations dependent upon the direction of current flowing through the coils 34 and 36. Each core member includes an end portion and in particular core 30 includes end portion 38 and core 32 includes end portion 40. The end portions extend out from the interior of the coils and are used to provide for magnetic fields of magnetic field of particular polarities to interact with permanent magnet which form part of a rotor.

The armature formed by the cores and coils are electromagnets which are supported within the housing 10 through the use of a mounting block and spacers including mounting block 42 and spacers 44, 46 and 48. In particular, screw members 50 and 52 extend through openings in the housing 10 and pass through openings in the spacers 44 and 46 and the mounting block 42 to be received within threaded openings 54 and 56 in one end of the cores 30 and 32. At the other end, the cores 30 and 32 pass through openings in the plate member 48 and with the enlarged head portions 38 and 40 pressed against the plate member 48 so that the entire structure is locked as the screws 50 and 52 are tightened against the upper surface of the housing 10.

The housing 10 also supports the electrical connections to the actuator of the present invention. Specifically, as seen in FIG. 1, sets of electrical contacts 60 and 62 extend through the end wall of the housing 10 to provide for electrical connections within the actuator. As shown by the dotted outline in FIG. 2 and in the end view of FIG. 5, a pair of printed circuit boards 64 and 66 are disposed to either side of the coils 34 and 36. The printed circuit boards 64 and 66 are held in position by the mounting block 42 and spacer 48. Various electrical connections are provided on the printed circuit boards 64 and 66 to provide for the proper connection of electrical power supplied to and output indications read from the actuator through the sets of contacts 60 and 62. The ends of the electrical coils 34 and 36 are coupled to the printed circuit board as well as a pair of switch members whose disposition and function will be explained in a later portion of this specification.

Figure 5:
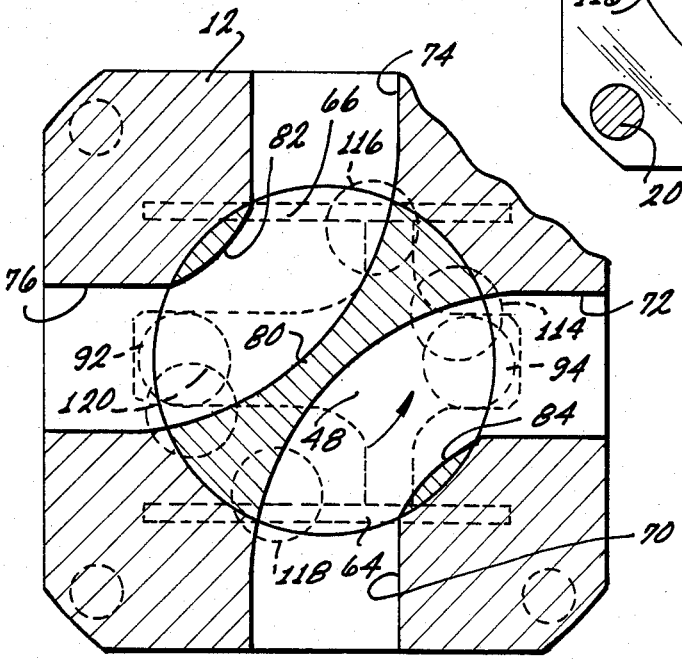
FIG. 5 is a cross-sectional view of the structure taken along lines 5—5 of FIG. 3.

The lower housing 12 contains the microwave switch itself which is shown to be a waveguide switch. In addition, the lower housing contains the rotor portion of the actuator. The housing 12 includes a plurality of waveguide ports 70 through 76 located at right angles to each other on all four sides of the housing 12. A central rotary member 80 includes a pair of waveguide passages 82 and 84 to interconnect particular pairs of the ports 70 through 76. For example, as shown in FIG. 5 and in the particular position shown, passageway 82 interconnects ports 74 and 76 while passageway 84 interconnects ports 70 and 72. Upon a ninety degree rotation of the rotary member 80, passageway 82 interconnects ports 70 and 76 while passageway 84 interconnects ports 72 and 74.

The rotary member 80 is supported for rotation within the lower housing 12 through the use of bearing structures 86 and 88 supporting the ends of the rotary member. The entire bearing structure is located within the lower housing 12 and there are no moveable parts or bearings located in the upper housing 10. The lower bearing 88 is supported within a recess in the bottom wall of the housing 12. The upper bearing 86 is supported within a cylindrical bearing sleeve 90 which extends downward from the center plate 14.

The center plate 14 includes a plurality of openings to receive a plurality of components forming part of the rotary actuator of the present invention. In particular, a pair of openings 92 and 94 allow for the enlarged end portions 38 and 40 of the cores 30 and 32 to extend through the center plate 14 and provide for concentration of the magnetic fields produced when the coils 36 and 38 are energized. Center plate 14 also includes cut-outs 96 and 98 which cut-outs allow for the positioning of magnetically actuated reed switches 100 and 102. The reed switches may be mounted at the bottom of and supported by the printed circuit boards 64 and 66.

Dependent upon the position of actuation of the rotary actuator of the present invention, one or the other of the reed switches will be in a closed position while the other will be in an open position. This allows for the production of an output signal from the rotary actuator to provide for an output indication of the position of the rotary actuator. The center plate 14 also includes a pair of openings 104 and 106 to receive and support the ends of pin members 108 and 110, as shown in FIG. 1. The pin members 108 and 110 extend from and are supported by the lower housing 12.

Physically attached to the top of the rotary member 80 is the rotor of the rotary actuator of the present invention. Specifically, the rotor is formed as a flat ring 112 and attached to the top of the flat ring are two pairs of permanent magnets. In particular, a first pair of permanent magnets 114 and 116 have a first polarity and a second pair of permanent magnets 118 and 120 have a polarity opposite to the polarity of the first pair. For example, the pair of magnets 114 and 116 may have a polarity providing a north pole at the upper surface of the magnets, as marked in the drawings, while the second pair of permanent magnets 118 and 120 have a polarity providing a south pole at the upper surface of the magnets, as marked in the drawings.

The flat ring member 112 includes a pair of oppositely disposed tabs 122 and 124, and with tab 122 in combination with the pins 108 and 110 providing for a limit stop to the rotational travel of the ring member 112. The travel is limited to approximately ninety degrees for the rotary member 80. The tab 124 provides for a balance weight for the side of the ring member opposite the tab 122. The permanent magnets 114 through 120 are symetrically mounted on the flat ring member 12 so that the entire rotary structure, supported between the upper and lower bearings 86 and 88, is balanced for smooth operation. The ring member 112 is mechanically connected to the rotary member 80 by a pair of screws 126 and 128 which lock the flat ring member at the top of the rotary member 80.

The operation of the rotary actuator of the present invention is as follows: The pair of permanent magnets 114 and 116 exhibit a north pole at their upper surface and the pair of permanent magnets 118 and 120 exhibit a south pole at their upper surfaces. In the position of the actuator shown in FIG. 3 and with the actuator being held in that position, the current is passed through coils 34 and 36 in a direction to provide for opposite polarities at the bottom pole faces for the flange portions 38 and 40 of the cores 30 and 32. Specifically, the bottom pole faces are excited to be north for member 38 and south for member 40. With that excitation, the permanent magnets 114 and 116 are attracted to the flange portion 40 of the core 32 and similarly the permanent magnets 118 and 120 are attracted to the flange portion 38 of the core 30.

Figure 4:
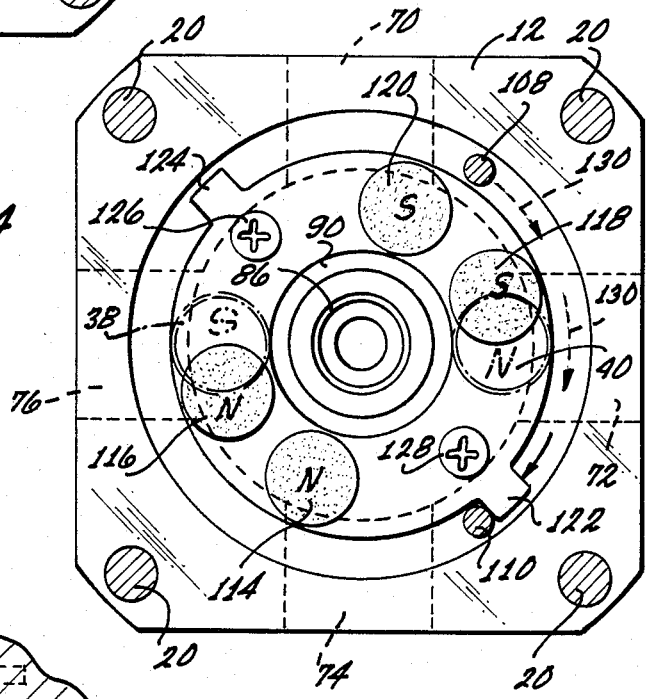
FIG. 4 is a view of the actuator in a second switch position and similar to FIG. 3 but with the center plate removed.

If the current flow through of the coils 34 and 36 is reversed so that the bottom face of the flange portion 38 is now a south pole and the bottom face of the flange portion 40 is a north pole, this immediately starts the rotary assembly to rotate in the direction of the arrow 130 shown in FIG. 4. This rotation occurs because the bottom face of each of the flange portions 38 and 40 now has the same polarity as the adjacently disposed pair of permanent magnets and this causes a repulsion between the permanent magnets and the core members. The repulsion produces a rotation of the flat ring 112 with a concurrent rotation of the rotary member 80.

As the ring member 112 rotates, each pair of permanent magnets is now directed to the flange portion having an opposite polarity so that the permanent magnets are now attracted to the flange portions 38 and 40. The ring member thereby rotates to the position of the actuator shown in FIG. 4 which rotation is limited by the stop pin 110. Specifically, in FIG. 4, the current flow through the coils 34 and 36 is in a direction to provide for the bottom surfaces of the flange portions 38 and 40 having a south and north pole respectively. The south pole for the flange portion 38 thereby attracts the north pole for the permanent magnets 116 and 114 and similarly the north pole for the flange 40 attracts the south pole of the permanent magnets 118 and 120. This combination of initial repulsion and then attraction insures that the rotary actuator will not stall in a central position.

It can be seen therefore, that the axial excitation between the permament magnets and the core members is converted to rotary actuation of the microwave switch. This rotary actuation is accomplished using very simple structure which is small in size and light in weight. In order to insure that the permanent magnets 114 through 118 provide for sufficient magnetic interaction with the cores 30 and 32 when excited, these magnets are perferably made of a powerful magnetic material such as a rare earth material. Specifically, the preferred magnetic material for the permanent magnets is samarium cobalt.

One inherent advantage of the structure of the present invention is that if power is removed from the coils, the permanent magnets will latch the rotary actuator in the last actuated position. This latching will be in either of the positions and is only dependent upon the direction of current flow through the coils immediately before power was removed. This latching allows the actuator to maintain its position without the constant application of power which of course reduces the power drain in the system.

Figure 3:
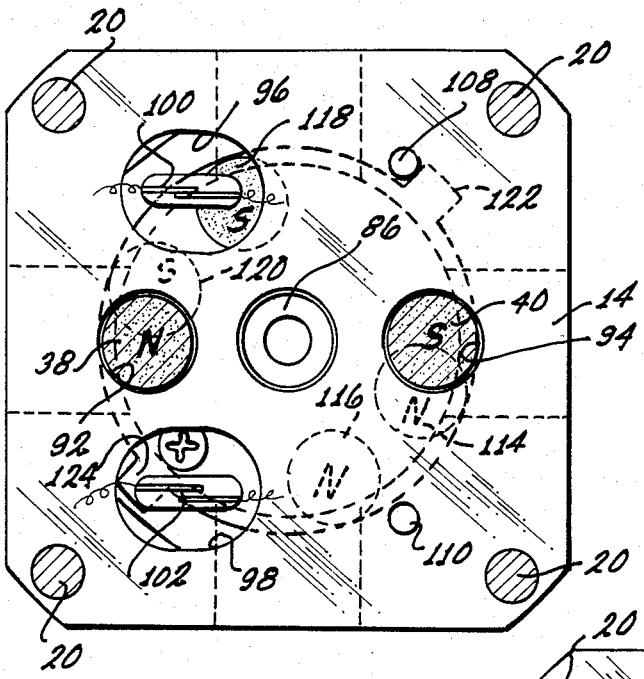
FIG. 3 is a view of the actuator in a first switch position taken along lines 3—3 of FIG. 2 and including a center plate.

Another advantage of the present invention is that the use of the axially excitated permanent magnets, which is converted to a rotary actuation, may also produce an inherent output indication such as through the use of magnetically operated switches, such as the reed switches 100 and 102 shown in FIG. 3. In the position shown in FIG. 3, the permanent magnets 118 and 120 provide for the switch 100 being closed and the switch 102 being open and thereby indicating a first fixed position for the switch.

The switch 102 is open since the closest permanent magnet 116 to the switch is far enough away not to produce closure of this switch. In the second fixed rotary position shown in FIG. 4, the switch 102 is closed since the permanent magnets 114 and 116 would now provide for a sufficient magnetic field to close the switch. Similarly, the switch 100 is now open since this switch would not have a permanent magnet close enough to provide for closure of the reed switch 100. The reed switches 100 and 102 therefore are alternately opened and closed depending upon the position of actuation of the rotary actuator. Also, these switches are maintained in their open and closed positions even if power is removed since it is the field provided by the permanent magnet which affects closure of the reed switch.

The present invention therefore provides for a rotary actuator for a microwave switch with the actuator including axial excitation which is converted into rotary motion. The actuator is relatively small in size and light in weight when compared with prior art actuators. The actuator includes bearing structure located only in the microwave switch portion and with no rotary members or bearings in the stationary actuator section. The actuator includes the use of rare earth permanent magnets, such as samarium cobalt magnets, and with the actuator latched in the last actuated position with the power off and providing for a output indication again with the power off. The actuator has been shown for use specifically as a waveguide switch and as shown in FIG. 1, waveguide members 132, 134, 136 and 138 are shown attached to the various output ports. It should be appreciated however, that the actuator may be used with other types of microwave switches such as coaxial switches, microstrip switches, etc.

Although the present invention has been shown with reference to a particular embodiment it is to be appreciated that the various adaptations and modifications may be made and the invention is only to be limited by the appended claims.

I claim:

1. A rotary actuator for a microwave switch, including, a stationary armature including a pair of spaced side by side cores positioned along parallel axes and with a coil means wound around the cores to form a pair of side by side electromagnets and with the polarity at the ends of the spaced side by side cores in accordance with the direction of current flow through the coil means upon the application of electrical energy to the coil means, a rotor positioned adjacent to one end of the spaced side by side cores and with the rotor supported for rotation in a plane perpendicular to the parallel axes of the cores, the rotor including a plurality of spaced permanent magnets located axially relative to the one end of the spaced side by side cores and with the application of electrical energy to the coil means providing axial excitation to produce magnetic interaction between the permanent magnets and the cores and provide rotary travel of the rotor in one of two opposite directions in accordance with the direction of current flow through the coil means, and stop means located in the path of rotation of the rotor to engage a portion of the rotor to limit the travel of the rotor between fixed positions.

2. The rotary actuator of claim 1 additionally including a cup shaped housing for receiving and supporting the stationary actuator and with the one end of the spaced side by side cores supported to extend out the open end of the cup shaped housing.

3. The rotary actuator of claim 2 additionally including at least one printed circuit board for providing electrical wiring to interconnect the coils and with the printed circuit board located and supported within the housing and additionally including electrical connectors extending through the closed end of the cup shaped housing for electrical connection to the printed circuit board.

4. The rotary actuator of claim 2 additionally including a microwave switch and with the microwave switch located within a switch housing and with the cup shaped housing and the switch housing coupled together and wherein the microwave switch includes a rotary member coupled to the rotor for providing travel of the rotary member between the fixed positions.

5. The rotary actuator of claim 4 additionally including a center plate located intermediate the cup shaped housing and the switch housing and with the center plate interconnecting the cup shaped housing with the switch housing.

6. The rotary actuator of claim 5 wherein the center plate includes at least a pair of openings located to receive the ends of the spaced side by side cores which extend out the open end of the cup shaped housing.

7. The rotary actuator of claim 4 wherein the rotary member is journaled for rotation within bearings and with the bearings located within the switch housing.

8. The rotary actuator of claim 7 wherein the microwave switch is a waveguide switch and within the switch housing included a plurality of ports and wherein the rotary member includes at least one passageway for interconnecting different pairs of ports in accordance with the fixed positions for the rotary member.

9. The rotary actuator of claim 1 wherein the rotor includes at least one extending tab and additionally including at least one stop pin extending into the path of rotation of the extending tab of the rotor.

10. The rotary actuator of claim 1 wherein the plurality of spaced permanent magnets are formed in pairs of magnets of like polarity and with each change in direction of current flow providing for one of the magnets in each pair being repulsed by an associated one of the ends of the cores and with the other of the magnets in each pair being attracted by the other one of the ends of the cores.

11. The rotary actuator of claim 1 additionally including at least a pair of magnetically operated switches each located adjacent particular ones of the permanent magnets in the fixed positions of the rotor to provide for an alternate one of the switches being on while the other is off.

12. A rotary actuator for a microwave switch, including, a stationary armature including at least one core positioned along a particular axis and with a coil means wound around the core to form at least one electromagnet and with the polarity at the end of the core in accordance with the direction of current flow through the coil means upon the application of electrical energy to the coil means, a rotor positioned adjacent to one end of the core and with the rotor supported for rotation in a plane perpendicular to the particular axis of the core, the rotor including a plurality of spaced permanent magnets located axially relative to the one end of the one core and with the application of electrical energy to the coil means providing axial excitation to produce magnetic interaction between the permanent magnets and the core and provide rotary travel of the rotor in one of two opposite directions in accordance with the direction of current flow through the coil means, and stop means located in the path of rotation of the rotor to engage a portion of the rotor to limit the travel of the rotor between fixed positions.

13. The rotary actuator of claim 1 additionally including a cup shaped housing for receiving and supporting the stationary actuator and with the one end of the core supported to extend out the open end of the cup shaped housing.

14. The rotary actuator of claim 13 additionally including at least one printed circuit board for providing electrical wiring to interconnect the coil means and with the printed circuit board located and supported within the housing and additionally including electrical connectors extending through the closed end of the cup shaped housing for electrical connection to the printed circuit board.

15. The rotary actuator of claim 13 additionally including a microwave switch and with the microwave switch located within a switch housing and with the cup shaped housing and the switch housing coupled together and wherein the microwave switch includes a rotary member coupled to the rotor for providing travel of the rotary member between the fixed positions.

16. The rotary actuator of claim 15 additionally including a center plate located intermediate the cup shaped housing and the switch housing and with the center plate interconnecting the cup shaped housing with the switch housing.

17. The rotary actuator of claim 16 wherein the center plate includes at least one opening located to receive the end of the core which extend out the open end of the cup shaped housing.

18. The rotary actuator of claim 15 wherein the rotary member is journaled for rotation within bearings and with the bearings located within the switch housing.

19. The rotary actuator of claim 18 wherein the microwave switch is a waveguide switch and within the switch housing included a plurality of ports and wherein the rotary member includes at least one passageway for interconnecting different pairs of ports in accordance with the fixed positions for the rotary member.

20. The rotary actuator of claim 12 wherein the rotor includes at least one extending tab and additionally including at least one stop pin extending into the path of rotation of the extending tab of the rotor.

21. The rotary actuator of claim 12 wherein the plurality of spaced permanent magnets are formed of magnets of opposite polarity and with each change in direction of current flow providing for one of the magnets being repulsed by the end of the core and with the other of the magnets being attracted by the end of the core.

22. The rotary actuator of claim 12 additionally including at least a pair of magnetically operated switches each located adjacent particular ones of the permanent magnets in the fixed positions of the rotor to provide for an alternate one of the switches being on while the other is off.

* * * * *